US009905355B2

(12) United States Patent
Takagi et al.

(10) Patent No.: US 9,905,355 B2
(45) Date of Patent: Feb. 27, 2018

(54) COIL COMPONENT

(71) Applicant: TDK CORPORATION, Tokyo (JP)

(72) Inventors: Nobuo Takagi, Tokyo (JP); Tasuku Mikogami, Tokyo (JP); Setu Tsuchida, Yamagata (JP); Hiroyuki Abe, Yamagata (JP)

(73) Assignee: TDK CORPORATION, Tokyo (JP)

( * ) Notice: Subject to any disclaimer, the term of this patent is extended or adjusted under 35 U.S.C. 154(b) by 285 days.

(21) Appl. No.: 14/789,540

(22) Filed: Jul. 1, 2015

(65) Prior Publication Data

US 2016/0020012 A1 Jan. 21, 2016

(30) Foreign Application Priority Data

Jul. 17, 2014 (JP) ..... 2014-147157
May 11, 2015 (JP) ..... 2015-096645

(51) Int. Cl.

| | |
|---|---|
| ***H01F 27/06*** | (2006.01) |
| ***H01F 27/30*** | (2006.01) |
| ***H01F 27/02*** | (2006.01) |
| ***H01F 27/26*** | (2006.01) |
| *H01F 19/08* | (2006.01) |

(52) U.S. Cl.
CPC ..... *H01F 27/306* (2013.01); *H01F 27/266* (2013.01); *H01F 2019/085* (2013.01)

(58) Field of Classification Search
USPC ..... 336/65, 192, 83, 208
See application file for complete search history.

(56) References Cited

U.S. PATENT DOCUMENTS

| | | | | |
|---|---|---|---|---|
| 7,688,173 | B2 * | 3/2010 | Azuma | H01F 27/292 336/200 |
| 2003/0071704 | A1 * | 4/2003 | Toi | H01F 17/045 336/83 |
| 2009/0219127 | A1 * | 9/2009 | Tomonari | H01F 27/29 336/192 |
| 2012/0133469 | A1 * | 5/2012 | Tomonari | H01F 27/292 336/192 |
| 2014/0292467 | A1 * | 10/2014 | Tai | H01F 27/24 336/192 |

FOREIGN PATENT DOCUMENTS

JP 2008-034777 A 2/2008

* cited by examiner

*Primary Examiner* — Elvin G Enad
*Assistant Examiner* — Kazi Hossain
(74) *Attorney, Agent, or Firm* — Arent Fox LLP

(57) ABSTRACT

A coil component includes a first core, a second core, a lead wire, an outside mark, and an inside mark. The first core includes a winding portion and a pair of core ends. The second core connects a pair of the core ends and includes an inside surface and an outside surface. The lead wire is wound around the winding portion. The outside mark is formed on the outside surface of the second core and designed to change its arrangement at the time of rotating the second core by 90 degrees in a rotational direction whose central axis is along a normal direction of the outside surface. The inside mark with undulation is formed on the inside surface of the second core and designed to change its arrangement at the time of rotating the second core by 90 degrees in the rotational direction.

9 Claims, 9 Drawing Sheets

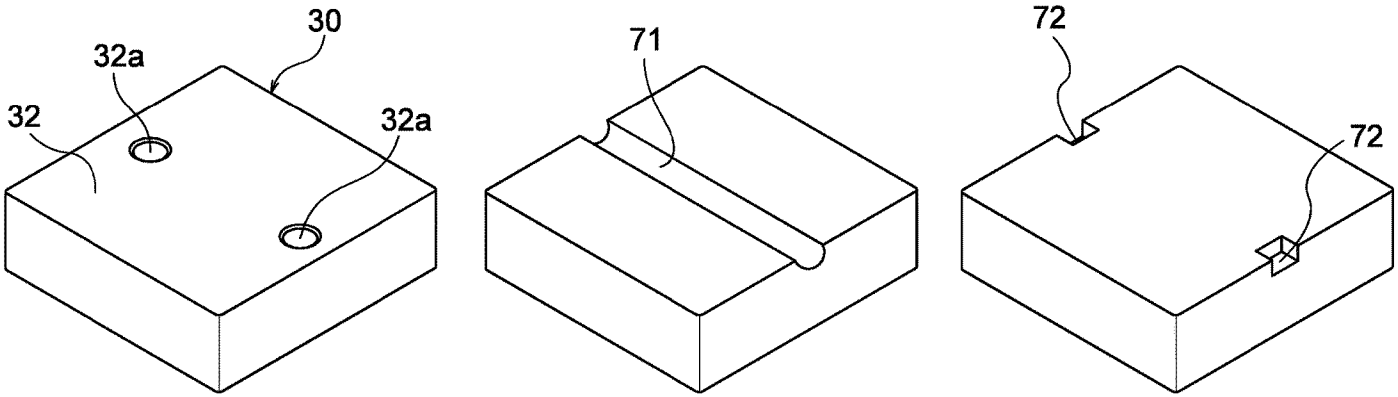
FIG. 8A
FIG. 8B
FIG. 8C
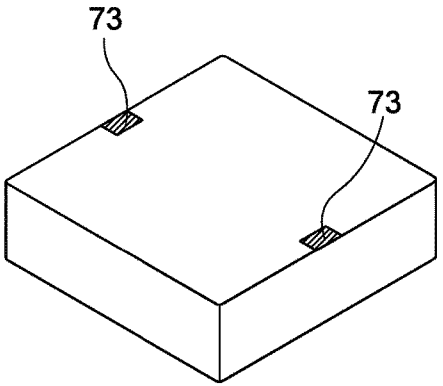
FIG. 8D
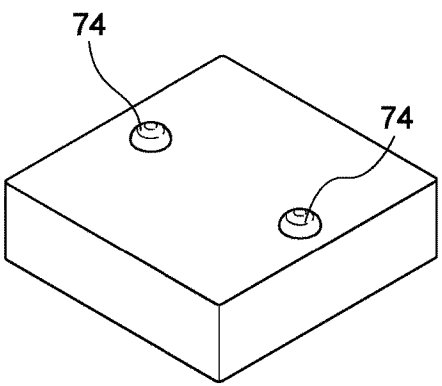
FIG. 8E

COIL COMPONENT

CROSS-REFERENCE TO RELATED APPLICATIONS

This application is based upon and claims the priority of the prior Japanese Patent Application No. 2014-147157, filed Jul. 17, 2014, and prior Japanese Patent Application No. 2015-096645, filed May 11, 2015, both of which are incorporated herein by reference in their entirety.

BACKGROUND OF THE INVENTION

1. Field of the Invention

The present invention relates to a coil component with a core combining a first core and a second core. The first core is wound by a coil. The second core with a plate shape is attached to the first core to form a magnetic path connecting to the first core.

2. Description of the Related Art

With respect to coil components used as pulse transformers or so, there is a demand for coil components combining two cores of a core with a drum shape and a core with a plate shape, not for coil components using a toroidal core, from a request such as miniaturization, low profile, and rationalization of assembling process.

A coil component has a core combining a first core wound by a coil and a second core with a plate shape attached to the first core to form a magnetic path connecting to the first core, and has a rectangular parallelepiped outer shape suitable for surface mounting (JP Patent Application Laid Open No. 2008-34777 etc.).

SUMMARY OF THE INVENTION

When the coil component with the core combining the first core wound by the coil and the second core with a plate shape is used for surface mounting, a mounting machine is required to properly recognize posture of the coil component. To make it easier to recognize posture of the coil component, for example, there may be a method for forming marks on the surface of the second core with a plate shape.

In such a coil component, it is a prerequisite that the second core having marks thereon and the first core are properly assembled in a predetermined arrangement relation to correctly detect posture of the coil component by the marks formed on the surface of the second core. However, in coil components having a conventional core with a plate shape, measuring electrical characteristics of the completed coil component is not enough to appropriately determine whether or not the second core and the first core are properly assembled due to simplicity of the shape of the second core with a plate shape, and thus the problem regarding complication of manufacturing process arises as below: An additional step is necessary to determine whether or not the second core and the first core are appropriately assembled from appearance of a product, for example.

In particular, the problem mentioned above is remarkable in case a core with a plate shape has an approximately square shape when viewed from a normal direction of a mounting surface. This is because even if the first core and the second core are assembled in improper posture where they are relatively rotated by 90 degrees from proper posture, electrical characteristics of the coil component are almost the same as those in proper posture.

The present invention has been achieved in consideration of the circumstances, and its object is to provide a coil component that is capable of easily determining whether or not the second core and the first core are properly assembled and has an excellent productivity.

To achieve the object, the coil component of the present invention comprises:

- a first core including a winding portion and a pair of core ends provided at both ends of the winding portion;
- a second core with a plate shape for connecting a pair of the core ends; and
- a lead wire wound around the winding portion, wherein
- the second core includes an inside surface and an outside surface,
- the inside surface has a pair of fixed parts fixing to a pair of the core ends respectively and faces the first core,
- the outside surface faces opposite to the inside surface,
- an outside mark is formed on the outside surface of the second core and designed to change its arrangement at the time of rotating the second core by 90 degrees in a rotational direction whose central axis is along a normal direction of the outside surface, and
- an inside mark with undulation is formed on the inside surface of the second core and designed to change its arrangement at the time of rotating the second core by 90 degrees in the rotational direction.

In the coil component of the present invention, when the second core is relatively rotated to the first core by 90 degrees in the rotational direction and attached in improper posture, a magnetic path formed by the first core and the second core changes its state due to an arrangement change of the inside marks with undulation formed on the inside surface, compared to when attached in proper posture without relative rotation. Thus, such a coil component can easily determine whether or not the second core and the first core are properly assembled by measuring electrical characteristics such as inductance, and has an excellent productivity.

Also, for example, at least a part of the inside mark may be formed on a mark-forming area of the inside surface of the second core, and the mark-forming area faces the core ends at the time of relatively rotating the second core to the first core by 90 degrees in the rotational direction.

In such a coil component, when the cores are assembled in improper posture where they are relatively rotated by 90 degrees in the rotational direction, the inside marks with undulation face the core ends, and thus a gap formed between the inside surface and the core ends becomes larger, compared to when assembled in proper posture. Then, when the second core and the first core are assembled in improper posture, this error can be easily detected due to decrease in inductance or so.

Also, for example, the inside mark may be formed on a remaining area excluding the fixed parts of the inside surface of the second core.

The inside marks may be formed on the fixed parts, but in this case, the gap in proper posture tends to be larger, compared to when neither the fixed parts nor the core ends facing thereto have undulation. However, a coil component where inside marks are formed on a remaining area excluding fixed parts can decrease leakage magnetic flux in cores assembled in proper posture, and easily detect the fact that the cores are assembled in improper posture due to decrease in inductance or so.

Also, for example, the inside mark may be one of a concave, a convex, a groove, and a rough surface formed on the inside surface.

With the inside marks having such a shape, a magnetic gap formed between the inside surface and the core ends can be changed securely.

Also, for example, the inside mark may have the same shape as the outside mark, and the inside mark of the inside surface may be arranged in the same way as the outside mark of the outside surface.

By providing the inside mark and the outside mark with the same shape and arrangement, one of the two surfaces of the second core before assembly may be assembled as an outside surface or an inside surface, and thus a coil with such a second core is easily assembled. Further, when the second core is manufactured by molding, the inside mark and the outside mark are arranged symmetrically with respect to a reference surface going through between the outside surface and the inside surface, which makes it possible to favorably maintain a density balance of the second core.

Also, for example, the second core may have an approximately square shape when viewed from the normal direction.

A coil component with a second core whose shape is approximately square when viewed from the normal direction is advantageous in terms of making the mounting surface smaller while maintaining its performance. However, when the second core has a square shape and no inside mark is formed, the following fact is hard to be detected from electrical characteristics of the coil component: the first core and the second core are assembled in improper posture where they are rotated by 90 degrees from a proper posture. On the other hand, even in such a case, the coil component of the present invention having the inside mark can easily detect the cores assembled in improper posture from electrical characteristics thereof.

BRIEF DESCRIPTION OF THE DRAWINGS

FIGS. 8A to FIG. 8E are a conceptual drawing explaining a shape of the inside mark.

DESCRIPTION OF THE PREFERRED EMBODIMENTS

Hereinafter, preferred embodiments of the present invention will be explained with reference to drawings.

Figure 1:
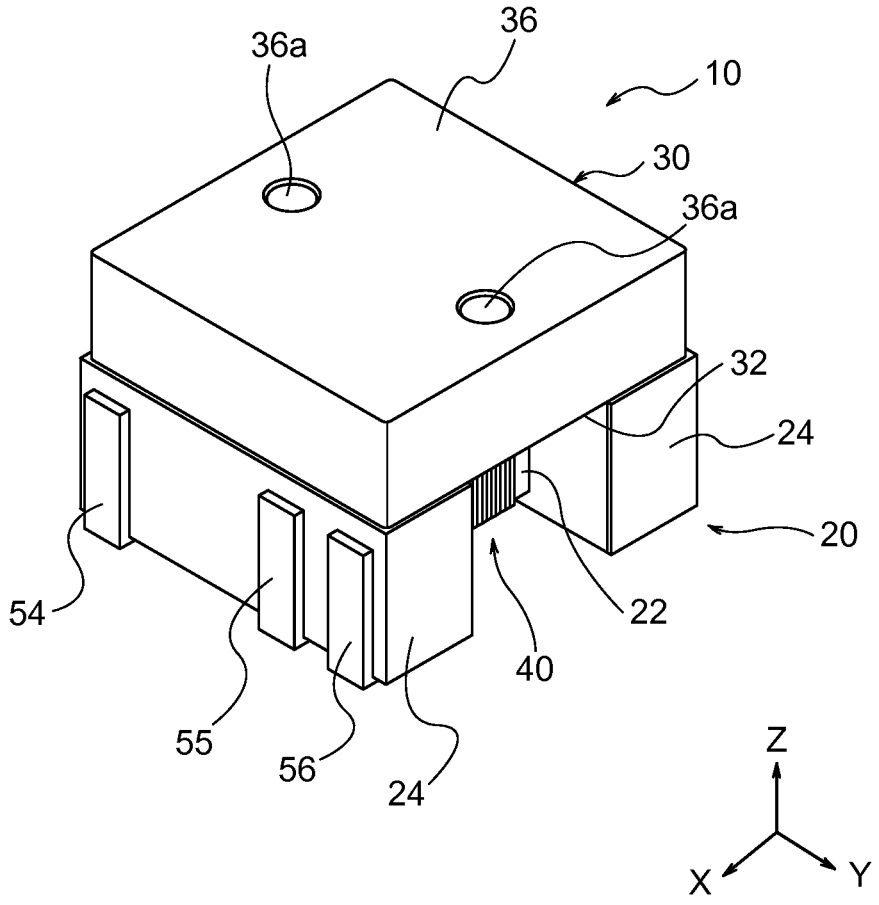
FIG. 1 is a whole perspective view of a coil component according to one embodiment of the present invention.

FIG. 1 is a schematically perspective view of a coil component 10 according to one embodiment of the present invention. The coil component 10 includes a first core 20 with a drum shape, a second core 30 with a plate shape, and a lead wire 40 wound around a winding portion 22 of the first core 20. Note that, in the description of the coil component 10, the X-axis direction is within a surface parallel to a mounting surface of the coil component 10 and is parallel to the winding portion 22 of the first core 20, the Y-axis direction is within a surface parallel to the mounting surface as similar to the X-axis and is vertical to the X-axis direction, and the Z-axis direction is a normal direction of the mounting surface.

The coil component 10 is a surface-mounting pulse transformer whose outer shape dimension is 3.2 mm wide, 2.8 mm high, and 3.2 mm long, but is not limited thereto. The coil component 10 may be one other than a pulse transformer, such as a balun transformer, a boosting transformer, or a chock coil.

Figure 3:
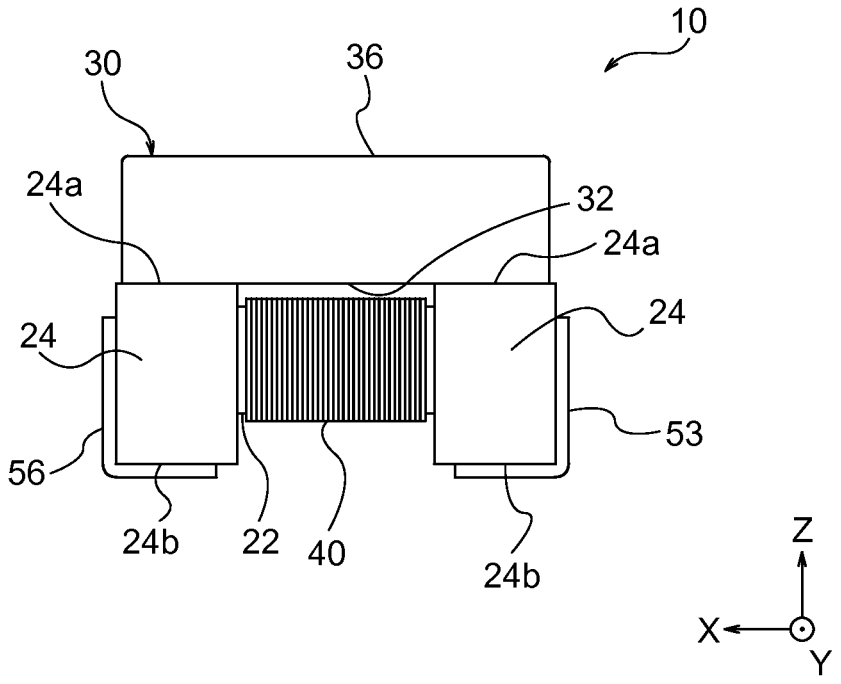
FIG. 3 is a front view of the coil component shown in FIG. 1.

As shown in FIG. 3 representing the front view of the coil component 10, the coil component 10 is constituted by combining the first core 20 and the second core 30. The first core 20 includes the bar-shaped winding portion 22 and a pair of flanges 24 provided at both ends of the winding portion 22 as a pair of core ends. As shown in FIG. 1 and FIG. 3, the flanges 24 have an approximately rectangular parallelepiped outer shape, and a pair of the flanges 24 is arranged to be approximately parallel to each other at a predetermined interval in the X-axis direction. The winding portion 22 is connected to central areas of surfaces facing each other of a pair of the flanges 24, and a pair of the flanges 24 are then connected.

Figure 2:
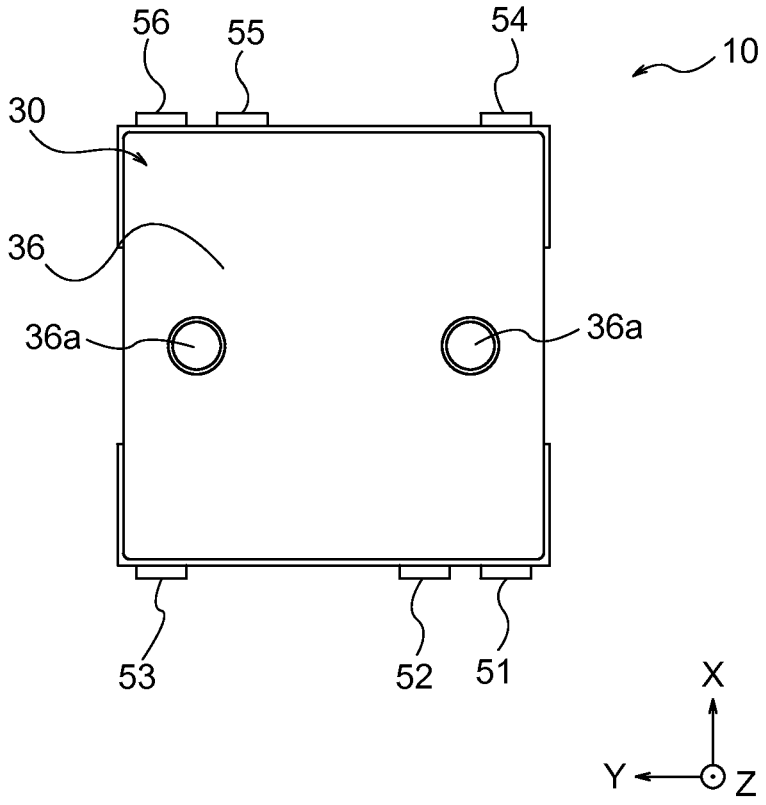
FIG. 2 is a top view of the coil component shown in FIG. 1.

The second core 30 is a core with a plate shape and has an approximately rectangular parallelepiped outer shape whose shortest sides are along in the Z-axis direction. The other sides of the second core 30 are parallel to the Y-axis direction or the X-axis direction. The second core 30 includes an inside surface 32 facing the first core 20 (the negative side of the Z-axis direction) and an outside surface 36 facing opposite to the inside surface 32 (the positive side of the Z-axis direction). As shown in FIG. 2, the second core 30 has an approximately square shape when viewed from the normal direction (Z-axis direction) of the outside surface 36, but may have the other shapes like a rectangular shape.

Figure 7A:
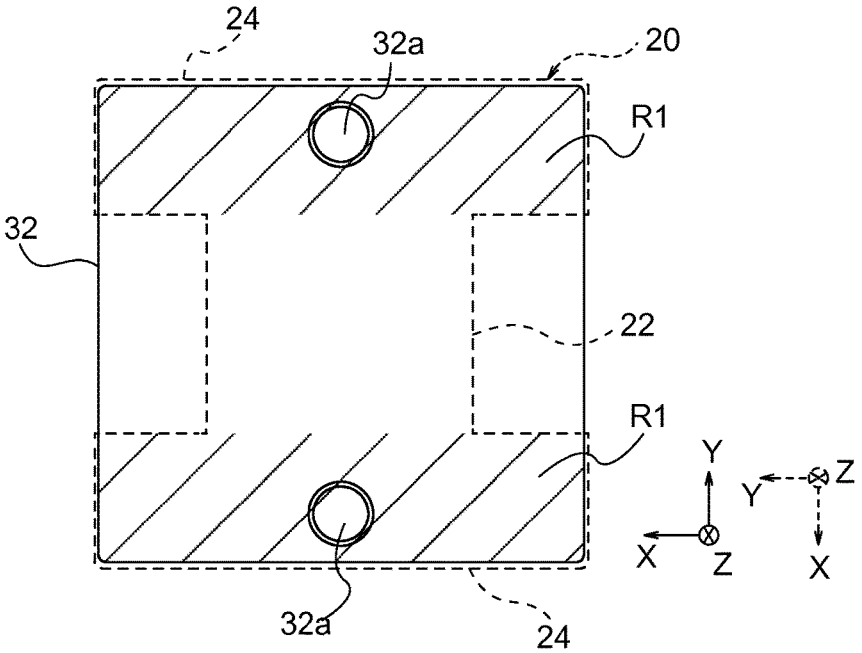
FIGS. 7A and FIG. 7B are a conceptual drawing explaining an area in which an inside mark is arranged.
Figure 7B:
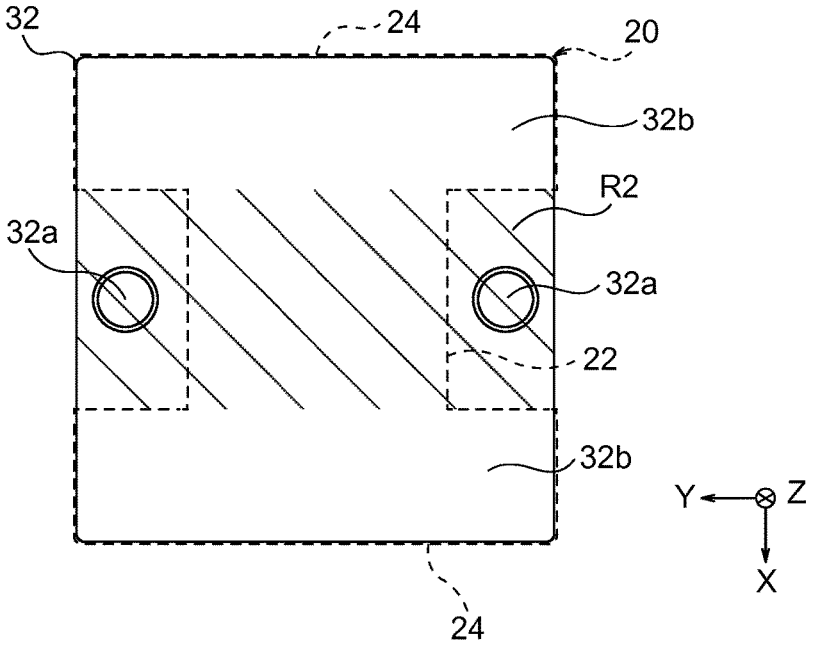

As shown in FIG. 7B representing the inside surface 32 viewed from the negative side of the Z-axis direction, the inside surface 32 includes a pair of fixed parts 32*b* fixed to a pair of the flanges 24 of the first core 20. As shown in FIG. 3, the fixed parts 32*b* of the inside surface 32 face joint surfaces 24*a* of the flanges 24 and are fixed to the joint surfaces 24*a*. From this, the second core 30 forms a magnetic path connecting to the first core 20.

As shown in FIG. 1 and FIG. 2, outside marks 36*a* are formed on the outside surface 36 of the second core 30. The outside marks 36*a* is designed to change their arrangement at the time of rotating the second core 30 by 90 degrees in a rotational direction whose central axis is along the normal direction of the outside surface 36. An apparatus for mounting the coil component 10 can detect the whole posture of the second core 30 and the coil component 10 by detecting how the outside marks 36*a* are arranged.

The outside marks 36*a* are constituted by concaves dented inside of the second core 30 compared to other areas of the outside surface 36, and their arrangement is confirmed by an apparatus for mounting the coil component 10. In the coil component 10, two outside marks 36*a* are formed along the Y-axis direction in the middle of the X-axis direction, but the outside mark 36*a* may adopt any embodiment that is designed to change its arrangement at the time of rotating the second core 30 by 90 degrees. In addition, the number of the outside marks 36*a* may be one or three or more.

Figure 6A:
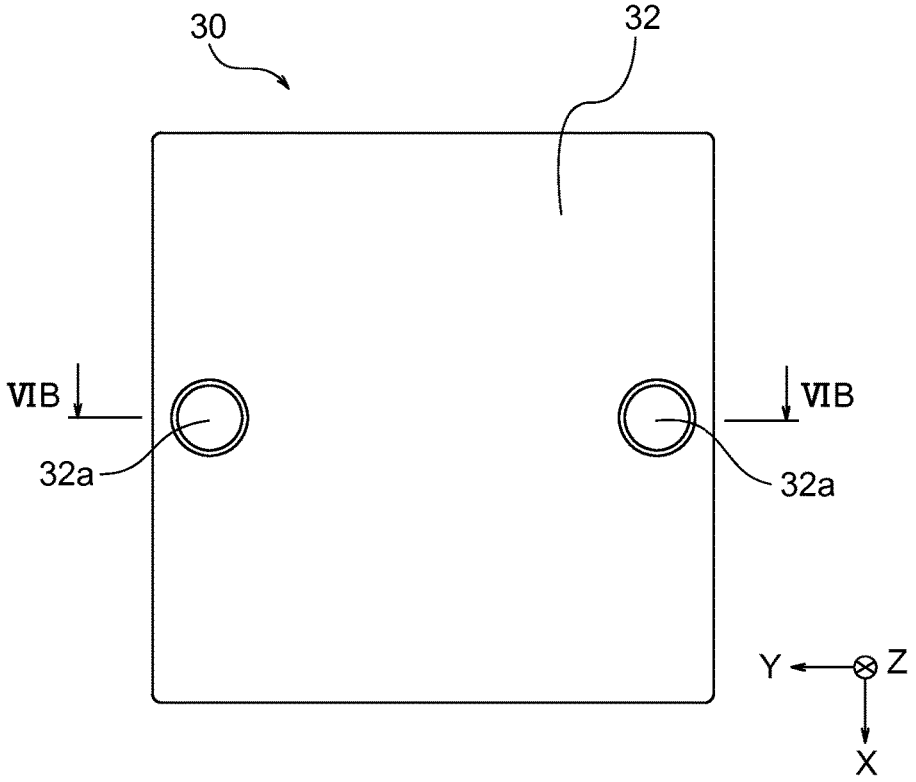
FIG. 6A is a bottom surface view of a second core shown in FIG. 1.

As shown in FIG. 6A viewing the second core 30 from the negative side of the Z-axis direction, inside marks 32*a* are formed on the inside surface 32 of the second core 30. The inside marks 32*a* have undulation at the time of rotating the second core 30 by 90 degrees in the rotational direction whose central axis is along the normal direction (Z-axis direction) of the outside surface 36. As shown in FIG. 7A and FIG. 7B, in the present embodiment, two inside marks 32*a* are formed along the Y-axis direction in the middle of the X-axis direction.

Figure 6B:
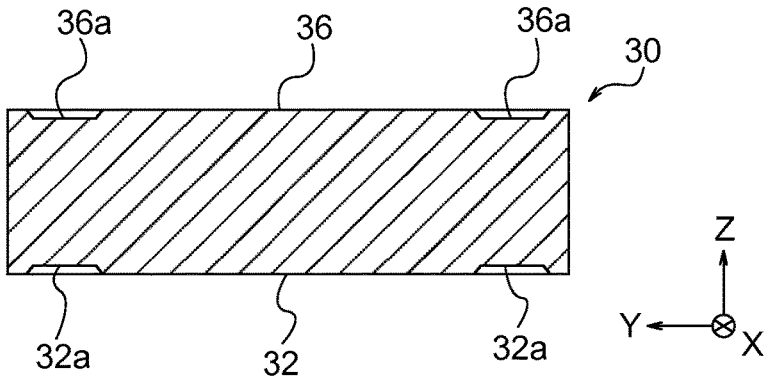
FIG. 6B is a cross section of a second core shown in FIG. 1.

As shown in FIG. 7B, when the first core 20 and the second core 30 are assembled in proper posture, the two inside marks 32*a* are arranged to sandwich the winding portion 22 of the first core 20 (the two inside marks are arranged along the Y-axis direction) as seen from the negative side of the Z-axis direction. On the other hand, as shown in FIG. 7A, when the second core 30 is rotated to the first core 20 by 90 degrees in the rotational direction whose central axis is along the normal direction (Z-axis direction) of the outside surface 36, the two inside marks 32*a* are aligned along an axis direction of the winding portion 22 (the X-axis direction in the coordinates of the first core 20 shown by a dotted line), and thus their arrangement is changed with respect to the first core 20. As shown in FIG. 6B, the inside marks 32*a* are constituted by concaves dented inside of the second core 30 compared to other areas of the inside surface 32 including the fixed parts 32*b*, and have undulation.

The inside marks 32*a* are formed on the inside surface 32 facing the first core 20 and have undulation. Unlike the outside marks 36*a*, the inside marks 32*a* are arranged in a position that is hard to be seen from the outside especially when the coil component 10 is mounted. However, since the inside marks 32*a* are formed on the inside surface 32 facing the first core 20 and have undulation, electrical characteristics of the coil component 10, such as inductance, are largely affected by whether the first core 20 and the second core 30 are assembled in proper posture or the cores are assembled in improper posture where they are relatively rotated by 90 degrees in the rotational direction. Thus, the coil component 10 enables to easily determine whether or not the second core 30 and the first core 20 are assembled in proper posture by measuring electrical characteristics, such as inductance, and achieves excellent productivity.

The inside marks 32*a* may adopt any shape and arrangement, but as shown in FIG. 7A, it is preferred that at least a part of the inside marks 32*a* be formed on mark-forming areas R1 (hatched areas of FIG. 7A) of the inside surface 32 of the second core 30, which face the flanges 24 when the second core 30 is relatively rotated to the first core 20 by 90 degrees in the rotational direction. In the coil component 10 with such inside marks 32*a*, when the cores are assembled in improper posture where they are relatively rotated by 90 degrees in the rotational direction, at least a part of the inside marks 32*a* with undulation faces the joint surfaces 24*a* of the flanges 24, and thus a gap formed between the inside surface 32 and the joint surfaces 24*a* becomes larger compared to when assembled in proper posture. Then, when the second core 30 and the first core 20 are assembled in improper posture, an inductance of the coil component 10 decreases, and thus an error of the assembling can be easily detected by determining electrical characteristics of the coil component 10.

It is preferred that the inside marks 32*a* be formed on a remaining area R2 excluding the fixed parts 32*b* of the inside surface 32 of the second core 30. The inside marks 32*a* may be formed in the fixed parts 32*b*, but in this case, the following problem arises: the gap between the first core 20 and the second core 30 in proper posture tends to be larger, compared to when neither the fixed parts 32*b* nor the joint surfaces 24*a* facing thereto have undulation, and an inductance decreases. However, in the coil component 10 where the inside marks 32 are formed in the remaining area R2, leakage magnetic flux in the cores assembled in proper posture can be decreased, and when assembled in improper posture, this can be detected by change of electrical characteristics such as inductance.

As shown in FIG. 2 and FIG. 6A, the inside marks 32*a* of the inside surface 32 are arranged in the same way as the outside marks 36*a* of the outside surface 36. Further, as shown in FIG. 6B, the inside marks 32*a* and the outside marks 36*a* are constituted by concaves dented inside of the second core 30 and have the same shape. With the second core 30 having such a shape, one of the two surfaces of the second core 30 before assembly may face the first core 20 when assembling the coil component 10, and thus this assembly is easy.

As shown in FIG. 1 to FIG. 3, the flanges 24 of the first core 20 are provided with terminal sections 51 to 56. The terminal sections 51 to 56 are constituted by a metal fitting having an approximately L-shaped outer shape, and at least parts of them are arranged on mounting surfaces 24*b* of the flanges 24. Note that, the mounting surfaces 24*b* of the flanges 24 are opposite to the joint surfaces 24*a* facing the inside surface 32 of the second core 30.

Figure 4A:
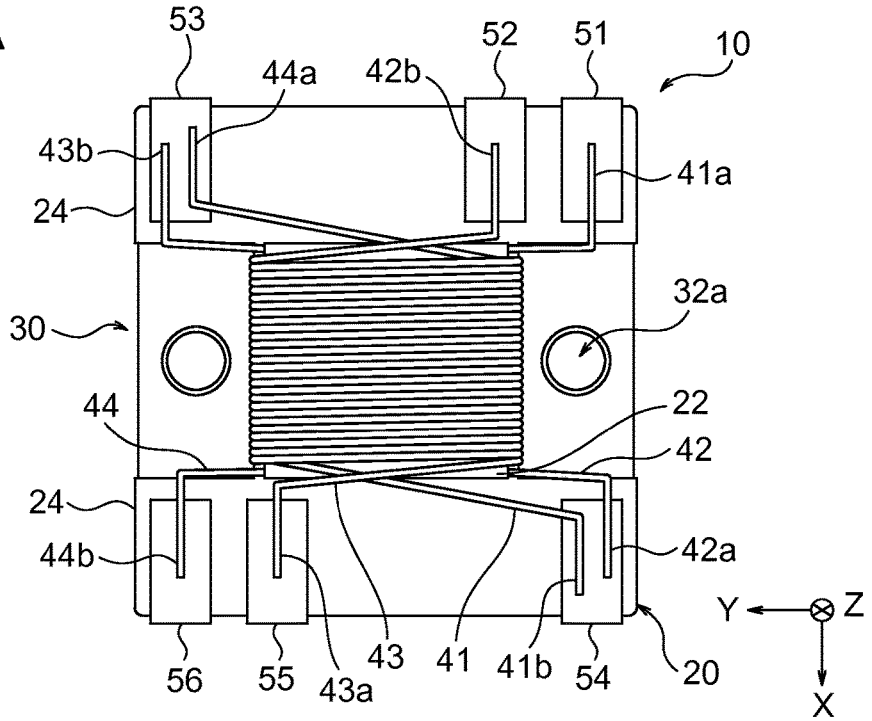
FIG. 4A is a bottom surface view of the coil component shown in FIG. 1.

As shown in FIG. 4A viewing the coil component 10 from the negative side of the Z-axis direction, three terminal sections 51 to 53 are arranged on one of the flanges 24, and the other three terminal sections 54 to 56 are arranged on the other flange 24. The intervals of the adjacent terminal sections are not equal. That is, the interval between the terminal section 52 and the terminal section 53 is designed to be larger than that between the terminal section 51 and the terminal section 52, and the interval between terminal section 54 and the terminal section 55 is designed to be larger than that between the terminal section 55 and the terminal section 56.

Figure 5:
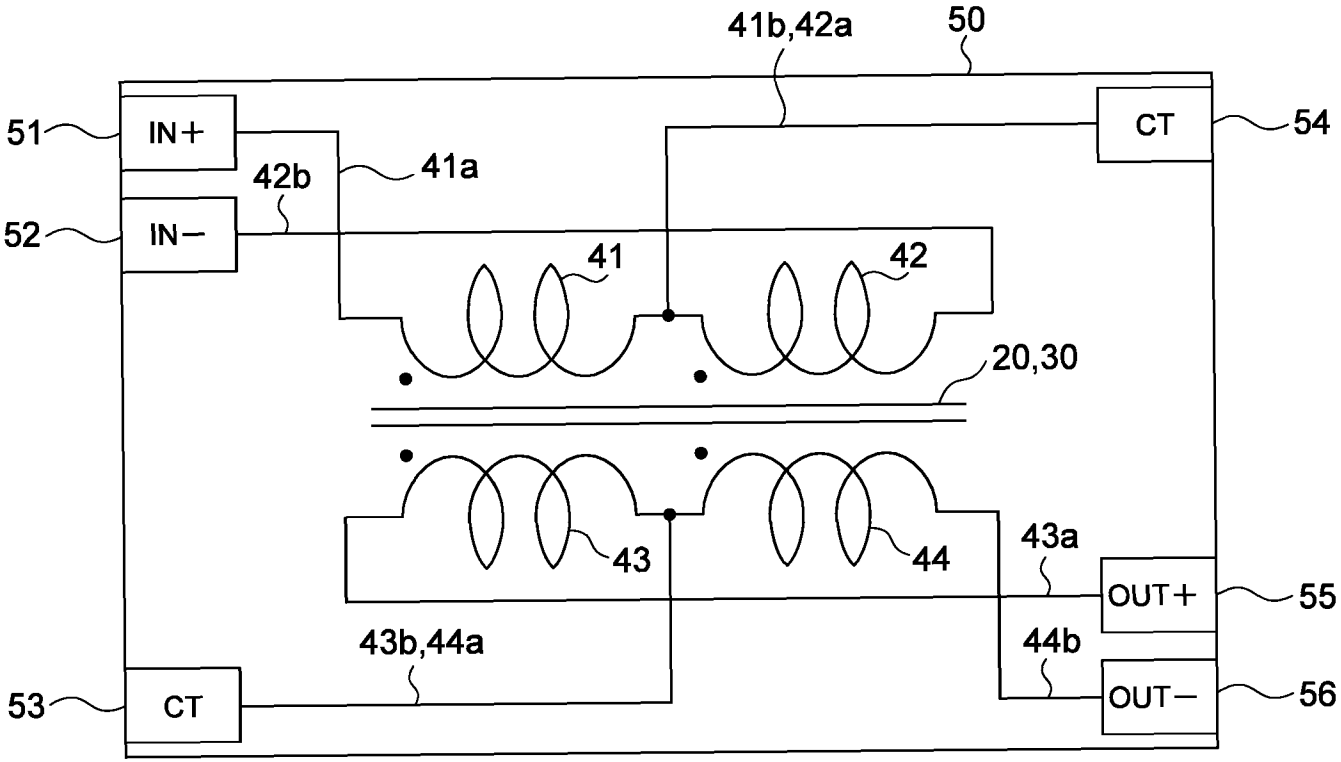
FIG. 5 is a circuit diagram of the coil component shown in FIG. 1.

As shown in FIG. 3, the lead wire 40 is wound around the winding portion 22 of the first core 20. As shown in FIG. 4A and FIG. 5, which is an equivalent circuit diagram, the lead wire 40 is constituted by four coated lead wires 41 to 44. The coated lead wires 41 to 44 are constituted by a core material made of a good conductor coated by an insulating coating film and are wound around the winding portion 22 with double-layer structure. The coated lead wires 41 and 44 are bifilar-wound around the winding portion 22 to form the first layer, and the coated lead wires 42 and 43 are bifilar-wound around the winding portion 22 to form the second layer. Each of the number of turns of the coated lead wires 41 to 44 may be the same or different.

Lead wire ends 41*a* and 41*b* of the coated lead wire 41 are respectively connected to the terminal sections 51 and 54, lead wire ends 44*a* and 44*b* of the coated lead wire 44 are respectively connected to the terminal sections 53 and 56, lead wire ends 42*a* and 42*b* of the coated lead wire 42 are respectively connected to the terminal sections 54 and 52, and lead wire ends 43*a* and 43*b* of the coated lead wire 43 are respectively connected to the terminal sections 55 and 53. As shown in FIG. 5, the terminal sections 51 and 52 are respectively used as a positive side terminal IN+ and a negative side terminal IN− of balanced input. The terminal sections 55 and 56 are respectively used as a positive side terminal OUT+ and a negative side terminal OUT− of balanced input. The terminal sections 53 and 54 are respectively used as an intermediate tap CT of input side and output side. The coated lead wires 41 and 42 configure a first winding of pulse transformer, and the coated lead wires 43 and 44 configure a second winding of pulse transformer.

Upon manufacturing the coil component 10, first of all, the drum-shaped first core 20 provided with the terminal sections 51 to 56 and the coated lead wires 41 to 44 are prepared. The first core 20 is, for example, manufactured by molding and sintering a magnetic material with relatively high permeability, such as magnetic powder of Ni—Zn ferrite and Mn—Zn ferrite. The metal terminal sections 51 to 56 are fixed to the flanges 24 of the first core 20 by adhesive or so. Note that, the terminal sections 51 to 56 may be provided at the flanges 24 by forming a conductive layer on the first core 20 by such as printing and plating, and by firing the conductive layer.

The coated lead wires 41 to 44 can include a core material made of a good conductor, such as copper (Cu), that is coated by an insulating material made of imide-modified polyurethane or so and whose outermost surface is further coated by a thin resin film such as polyester. The first core 20 where the prepared terminal sections 51 to 56 are mounted and the coated lead wires 41 to 44 are set to a winding machine, and the coated lead wires 41 to 44 are wound around the winding portion 22 of the first core 20 in predetermined order. The lead wire ends 41*a* to 44*a* and 41*b* to 44*b* of the wound coated lead wires 41 to 44 are fixed to the predetermined terminal sections 51 to 55 shown in FIG. 4A and FIG. 5 by thermocompression or laser joining Next, the second core 30 with a plate shape is prepared and joined to the first core 20 wound by the lead wire 40. As is the case with the first core 20, the second core 30 is made of a sintered body of a magnetic material such as Ni—Zn ferrite and Mn—Zn ferrite. As shown in FIG. 6B, in terms of favorably maintaining a density balance of the molded second core 30, it is preferred that the inside marks 32*a* and the outside marks 36*a* be arranged symmetrically with respect to a reference surface going through between the inside surface 32 and the outside surface 36.

The second core 30 is attached to the first core 20 in a predetermined posture by detecting the outside marks 36*a* and the inside marks 32*a*. The first core 20 and the second core 30 are fixed by bonding the joint surfaces 24*a* of the flanges 24 of the first core 20 and the fixed parts 32*b* of the inside surface 32 of the second core 30 using thermosetting adhesive. The coil component 10 is obtained accordingly.

Note that, if necessary, electrical characteristics of the obtained coil component 10 are measured. As shown in FIG. 7A, when the first core 20 and the second core 30 are assembled in improper posture where they are relatively rotated to proper posture by 90 degrees in the rotational direction, the inside marks 32*a* of the second core 30 face the joint surfaces 24*a* of the flanges 24. On the other hand, as shown in FIG. 7B, when the first core 20 and the second core 30 are assembled in proper posture, the inside marks 32*a* of the second core 30 do not face the joint surfaces 24*a*, but the flat fixed parts 32*b* face the joint surfaces 24*a*.

Due to such a difference, when the first core 20 and the second core 30 are assembled in improper posture, the gap formed between the inside surface 32 and the joint surfaces 24*a* becomes larger, compared to when assembled in proper posture, and this is detected as electrical characteristics of the coil component 10. Thus, in the coil component 10, the fact that the first core 20 and the second core 30 are assembled in improper posture can be easily detected by determining electrical characteristics of the coil component 10 without conducting an appearance determination.

The coil component 10 is explained based on the embodiment as the above, but the present invention is not limited to the embodiment and can be variously modified. Needless to say, modified embodiments are also included in the technical scope of the present invention. For example, FIG. 8A to FIG. 8E show the inside marks 32*a* formed on the inside surface 32 of the second core 30 together with their modified examples.

As shown in FIG. 8A to FIG. 8E, the inside marks 32*a* are constituted by a concave, a convex, a groove, a rough surface, and the like. FIG. 8A shows the inside marks 32*a* having a round concave shape are formed at two positions on the coil component 10 explained in the embodiment. FIG. 8B to FIG. 8E show inside surfaces of second cores according to modified embodiments. The inside mark 71 shown in FIG. 8B is constituted by a groove continuing along the middle of the inside surface.

Inside marks 72 shown in FIG. 8C are constituted by grooves formed by partly cutting both sides of the inside surface. Inside marks 73 shown in FIG. 8D are constituted by convexes formed by partly coating the inside surface with nonmagnetic metal paste. Inside marks 74 shown in FIG. 8E are constituted by protrusions formed on the inside surface. The inside marks may be constituted by a rough surface formed by performing sandblast or so to parts of the inside surface.

In this way, the inside marks are constituted by such as a concave, a convex, a groove, and a rough surface formed on the inside surface of the second core, and a coil component having the second core with such inside marks demonstrates the same effects as the coil component 10 of the embodiment. The inside marks may include both convexes formed by being coated with metal paste and marks with a relatively small undulation such as a rough surface formed by sandblast or so, as long as they can change a gap of cores at the time of posture change of the first core and the second core. Note that, the outside marks formed on the outside surface of the second core may have a shape with undulation as with the inside marks, but they are not limited thereto and may be any marks detectable by a detector or so.

The first core 20 is not limited to have a drum shape shown in the embodiment, and may have any shape, such as U-shape, with a pair of core ends at both ends of a winding portion. The two flanges 24 of the first core 20 may have the same or different shape. The first core 20 and the second core 30 are not limited to have a material of ferrite, and may be metal cores.

Figure 4B:
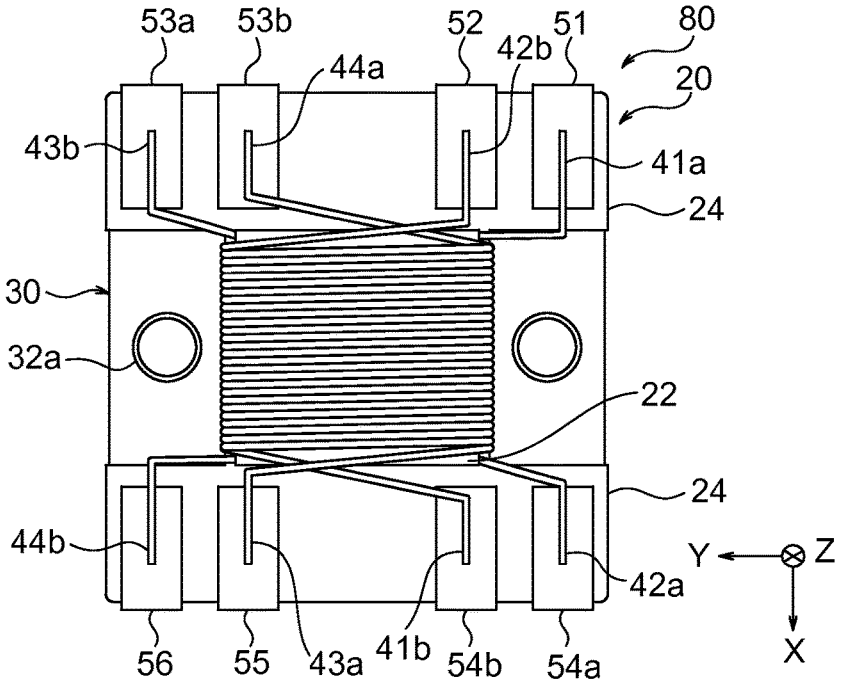
FIG. 4B is a bottom surface view of a coil component according to a modification example.

FIG. 4B is a bottom surface view of a coil component 80 according to a modification example viewed from the negative side of the Z-axis. As understood from comparison to FIG. 4A showing the coil component 10 according to the embodiment, the coil component 80 is different in having 8 terminal sections in total, that is, 4 each at flanges 24 on both ends, but its other structures are the same as the coil component 10. Terminal sections 53*a* and 53*b* of the coil component 80 correspond to the terminal section 53 of the coil component 10, and terminal sections 54*a* and 54*b* of the coil component 80 correspond to the terminal section 54 of the coil component 10.

In the coil component 80, an electrical connection between a lead wire end 43*b* and a lead wire end 44*b* and an electrical connection between a lead wire end 41*b* and a lead wire end 42*a* are conducted through a wiring pattern on a wiring board for mounting the coil component 80. The coil component 80 also demonstrates the same effects as the coil component 10 mentioned above.

Figure 9A:
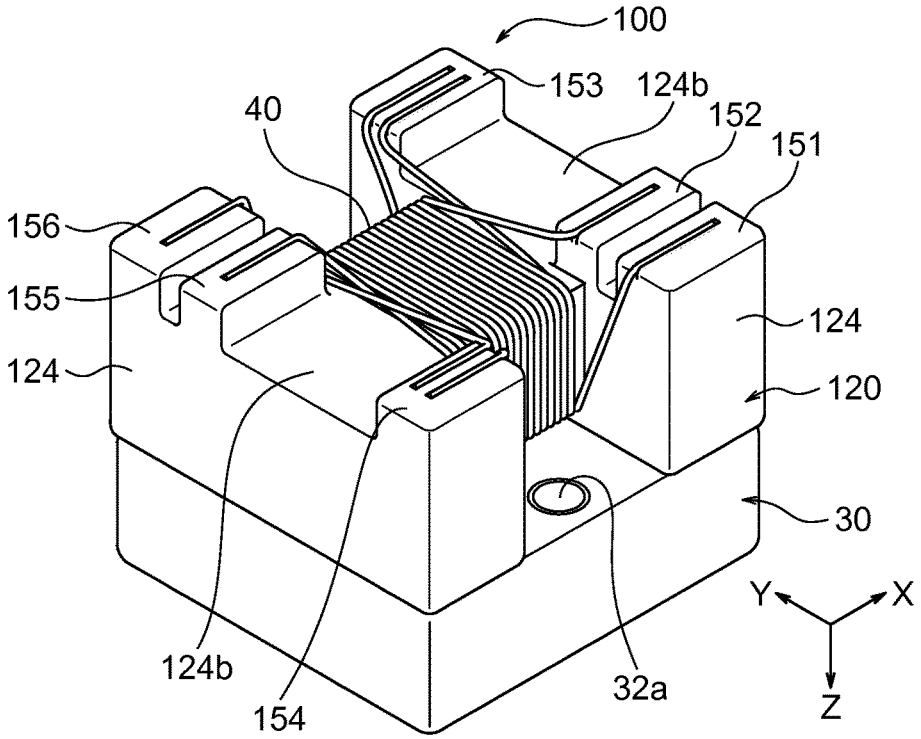
FIG. 9A is a whole perspective view of a coil component according to the second modification example.

FIG. 9A is a perspective view of a coil component 100 according to the second modification example. In the coil component 100, flanges 124 of a first core 120 have a shape different from that of the coil component 10 according to the embodiment, but the other structures are the same as the coil component 10. In the coil component 100, protrusions 151 to 156 protruding toward the negative side of the Z-axis are formed on mounting surfaces 124*b* of the flanges 124, and lead wire ends of each coated lead wire constituting a lead wire 40 are connected to the protrusions 151 to 156. The protrusions 151 to 153 formed on one flange 124 and the protrusions 154 to 156 formed on the other flange 124 are arranged on the mounting surfaces 124*b* at intervals and demonstrate the same functions as the terminal sections 51 to 53 and the terminal sections 54 to 56 according to the embodiment.

Figure 9B:
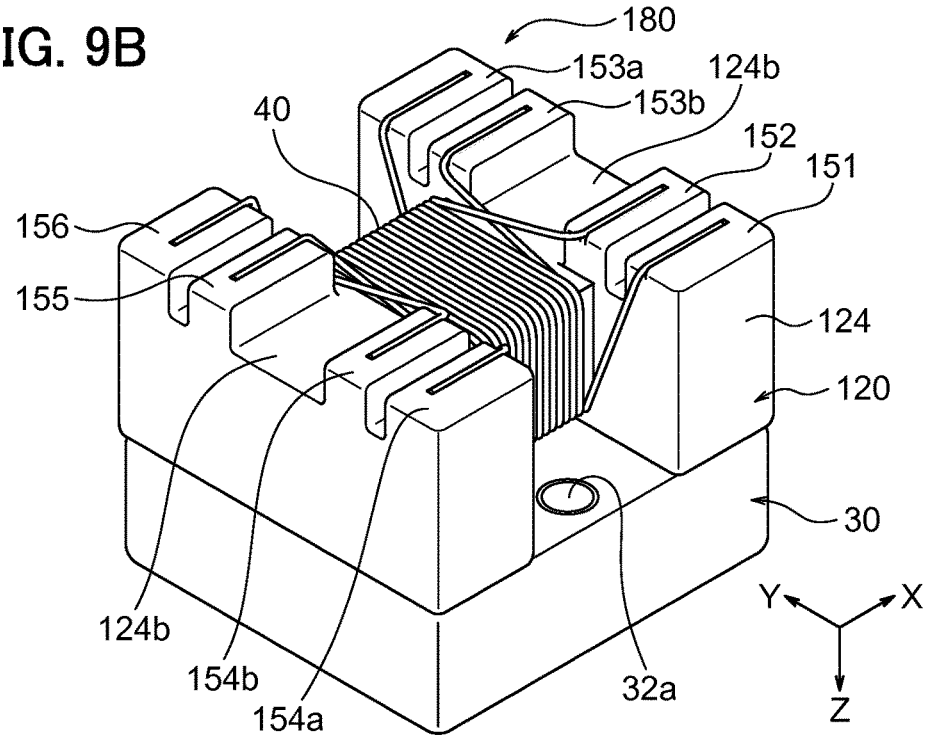
FIG. 9B is a whole perspective view of a coil component according to the third modification example.

FIG. 9B is a perspective view of a coil component 180 according to the third modification example. As understood from comparison to FIG. 9A showing the coil component 100 according to the second modification example, the coil component 180 is different in having 8 protrusions in total, that is, 4 each at flanges 124 of both ends, but its other structures are the same as the coil component 100. Protrusions 153*a* and 153*b* of the coil component 180 correspond to the terminal section 153 of the coil component 100, and protrusions 154*a* and 154*b* of the coil component 180 correspond to the terminal section 154 of the coil component 100.

In this way, the first core joined to the second core 30 where the inside marks 32*a* are formed has any shape, and the lead wire ends of the wire 40 may be fixed to the terminal sections or to the protrusions of the first core. The coil component 100 according to the first modification example and the coil component 180 according to the second modification example have the same effects as the coil component 10 according to the embodiment.

NUMERICAL REFERENCES

10 . . . coil component
20 . . . first core
22 . . . winding portion
24 . . . flange (core end)
30 . . . second core
32 . . . inside surface
32*a*, 71, 72, 73, 74 . . . inside mark
32*b* . . . fixed part
R1 . . . mark-forming area
36 . . . outside surface
36*a* . . . outside mark

The invention claimed is:

1. A coil component comprising:

a first core including a winding portion and a pair of core ends provided at both ends of the winding portion;

a second core with a plate shape for connecting a pair of the core ends; and a lead wire wound around the winding portion, wherein the second core includes an inside surface and an outside surface, the inside surface has a pair of fixed parts fixing to a pair of the core ends respectively and faces the first core, the outside surface faces opposite to the inside surface, an outside mark is formed on the outside surface of the second core and designed to change its arrangement at the time of rotating the second core by 90 degrees in a rotational direction whose central axis is along a normal direction of the outside surface, an inside mark with undulation is formed on the inside surface of the second core and designed to change its arrangement at the time of rotating the second core by 90 degrees in the rotational direction, and the second core has a substantially square shape when viewed from the normal direction.

2. The coil component as set forth in claim 1, wherein a part of the inside mark is formed on a mark-forming area of the inside surface of the second core and the mark-forming area faces the core ends at the time of relatively rotating the second core to the first core by 90 degrees in the rotational direction.

3. The coil component as set forth in claim 1, wherein the inside mark is formed on a remaining area excluding the fixed parts of the inside surface of the second core.

4. The coil component as set forth in claim 2, wherein the inside mark is formed on a remaining area excluding the fixed parts of the inside surface of the second core.

5. The coil component as set forth in claim 1, wherein the inside mark is one of a concave, a convex, a groove, and a rough surface formed on the inside surface.

6. The coil component as set forth in claim 2, wherein the inside mark is one of a concave, a convex, a groove, and a rough surface formed on the inside surface.

7. The coil component as set forth in claim 3, wherein the inside mark is one of a concave, a convex, a groove, and a rough surface formed on the inside surface.

8. The coil component as set forth in claim 4, wherein the inside mark is one of a concave, a convex, a groove, and a rough surface formed on the inside surface.

9. The coil component as set forth in claim 1, wherein the inside mark has the same shape as the outside mark and the inside mark of the inside surface is arranged in the same way as the outside mark of the outside surface.

* * * * *